United States Patent [19]

Williams

[11] 4,063,581

[45] Dec. 20, 1977

BEST AVAILABLE COPY

[54] CARRIER FOR TENNIS EQUIPMENT

[76] Inventor: Stanley Boyin Williams, 2088 E. Empire, Lot 151, Benton Harbor, Mich. 49022

[21] Appl. No.: 709,776

[22] Filed: July 29, 1976

[51] Int. Cl.[2] ..... B65D 85/00

[52] U.S. Cl. ..... 150/52 G; 206/315 R; 190/51; 190/18 A

[58] Field of Search ..... 150/52 R, 52 G; 190/18 A, 52, 51; 206/315 R, 315 B

[56] References Cited

U.S. PATENT DOCUMENTS

| | | | |
|---|---|---|---|
| 2,596,578 | 5/1952 | McIntyre | 190/18 A |
| 2,767,758 | 10/1956 | Haynes | 150/52 G |
| 2,925,283 | 2/1960 | Stilger | 190/18 A |
| 3,700,243 | 10/1972 | Kenney | 206/315 B |
| 3,917,038 | 11/1975 | Foge | 190/18 A |
| 3,946,839 | 3/1976 | Butler | 190/18 A |
| 3,963,103 | 6/1976 | Cowen | 190/52 |

FOREIGN PATENT DOCUMENTS

| | | | |
|---|---|---|---|
| 1,565,476 | 3/1969 | France | 206/315 B |
| 2,421,865 | 12/1974 | Germany | 200/315 |
| 342,412 | 2/1931 | United Kingdom | 150/52 G |
| 323,309 | 1/1930 | United Kingdom | 206/315 |
| 817,522 | 7/1959 | United Kingdom | 206/315 |
| 1,188,041 | 4/1970 | United Kingdom | 206/315 |

*Primary Examiner*—Ro E. Hart

*Attorney, Agent, or Firm*—Gary, Juettner & Pyle

[57] ABSTRACT

A carrier for tennis equipment is characterized by a generally rigid and easily transportable case which is internally configured and equipped to contain and protect equipment customarily used in the playing of tennis.

In the disclosed embodiment of the carrier, the case has inner walls in the shape of a tennis racquet for receiving and holding therewithin a plurality of racquets, and storage compartments are formed within the case for tennis balls, tennis shoes, and the like. A door hinged with the case closes the case, and an inner surface of the door advantageously is provided with pockets and/or elastic bands for conveniently holding toiletry and other items. The carrier is transportable either by wheels on the bottom of the case which enable the carrier to be rolled from one location to the next, or by a handle on the side of the case for lifting the carrier.

5 Claims, 3 Drawing Figures

74
20
78
66
62
56
50
32
46
48
3.
3.
56
30
60
64
66
80
70
68
70
52
54
62
66
56
34
22
42
36
24
44
38
72
26
76
72

74
20
78
32
82
58
80
82
28
24
76
26
76
72

56
33
24
32
46
48
28

CARRIER FOR TENNIS EQUIPMENT

BACKGROUND OF THE INVENTION

The present invention relates to carriers for sporting equipment and the like, and in particular to a carrier for tennis equipment.

Equipment brought to a tennis court by a tennis player generally consists, at a minimum, of a tennis racquet and balls. Often, however, tennis shoes, socks, toiletry items such as combs an/or hair brushes, and occasionally even a thermos of a drinkable beverage, are also brought to the court.

Such equipment is customarily carried as two separate parcels, one of which is the racquet and the other of which is ordinarily a canvas or other soft material flight bag type satchel for holding the remaining paraphernalia. Not only are the two separate parcels inconvenient to carry, but very little protection is offered against damage to the equipment. For example, while the rim and strung portion of the racquet may be somewhat protected against impact by attaching thereto a conventional open-sided protective framework, such a framework affords no protection to the handle of the racquet against impact or abrasion, or to the racquet as a whole against rain. Where the racquet is strung with cat gut, exposure to rain can readily ruin the stringing and necessitate restringing. Relative to the satchel, the soft sides thereof offer little if any resistance against crushing injury to the contents therein which may include, by way of example, a spare pair of eyeglasses or a relatively frangible thermos bottle. Further, such satchels are generally noncompartmentalized and do not maintain separate and in a neat condition equipment carried therein. Also, while some satchels are of sufficient size to accommodate therewithin the head of a tennis racquet with the handle thereof extending exterior of the satchel, the resulting "single" parcel is geometrically unweildy and heavy, making carrying thereof for any period of time a difficult and tiring task.

OBJECTS OF THE INVENTION

An object of the present invention is to provide a carrier which conveniently holds all of the equipment customarily associated with the playing of tennis.

Another object of the present invention is to provide such a carrier which is compartmentalized to maintain separate and protect the various pieces of the equipment.

A further object of the invention is to provide such a carrier which is easily and conveniently transportable.

Yet another object of the invention is to provide such a carrier which is of relatively rigid construction and completely closable about the equipment for protecting the equipment against damage as by impact or rain.

A still further object of the invention is to provide such a carrier which is esthetically attractive and forms a complementary piece of personal equipment.

SUMMARY OF THE INVENTION

In accordance with the present invention, a carrier for tennis equipment includes a generally rigid case which is internally configured and equipped to contain and maintain separate various equipment associated with the playing of tennis.

More particularly, the carrier has inner walls forming therewithin a compartment in the shape of a tennis racquet for receiving and holding a plurality of the racquets, and also forming a plurality of storage compartments for other equipment such as tennis balls, tennis shoes, and the like. A door is hinged with the case and is latchable therewith to completely close the case, and an inner surface of the door is provided with pockets and/or elastic bands. The case has a pair of rollers on the bottom thereof for rolling the carrier from one location to the next, the rollers being foldable within the case, if desired, for storage of the carrier or transport thereof by a handle provided on the side of the case for lifting the carrier.

As a consequence of the compartments within the case, tennis and/or other items therewithin are maintained separate and protected against damage by impact with each other or with objects exterior of the case. The hinged door completely encloses the case to securely maintain the equipment therein, and protects the equipment against damage as by rain, and the pockets and elastic bands on the inside of the door conveniently hold toiletry and/or other items.

The foregoing and other objects, advantages and features of the invention will become apparent from the following detailed description, when taken in conjunction with the appended drawings.

DETAILED DESCRIPTION

Figure 1:
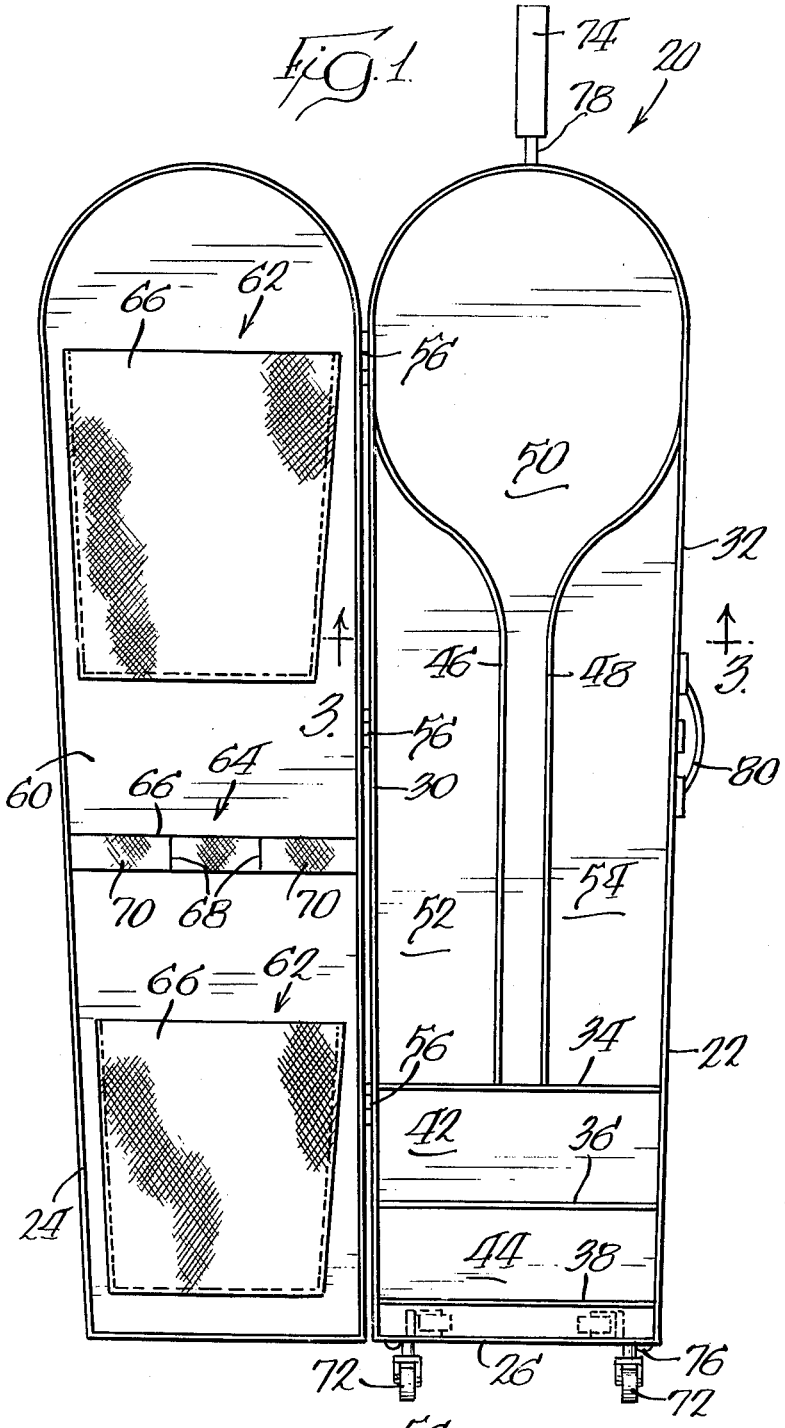
FIG. 1 is a front elevation view of a tennis equipment carrier embodying the teachings of the invention with a door thereof in an open position, particularly showing inner portions thereof for holding and maintaining separate various items of tennis and personal equipment.

The drawings illustrate a carrier for tennis equipment, indicated generally at 20, configured in accordance with a preferred embodiment of the invention. The carrier includes a case portion 22 and a door 24 which completely encloses the case when in a closed position. The case is provided with a plurality of wall areas therewithin configured to receive and hold separate tennis racquets and other equipment associated with the game of tennis, and the inner surface of the door has means for conveniently holding toiletry and various other items. The carrier may be formed of an economical polymer material which has sufficient rigidity to be shape-retentive and to support the equipment and other items therein, but which is resilent enough to resist breaking upon impact, such a material being polyethylene. It is understood, however, that any other material suitable for the purpose may be used for the carrier. The carrier may be fabricated in any esthetically desirable color, and when formed of a polymer the outer surfaces may have molded therein a simulated leather or other design.

In a preferred embodiment of the carrier the case 22 has a base wall 26, a rear wall 28, and side walls 30 and 32 which are generally planar and joined at right angles to form a container having an open side 33. The upper end of the rear wall is semicircular in shape, and the upper ends of the side walls are curved along the outer periphery of the rear wall and meet at their ends to form a semicircular upper end portion of the case 22 which is of a size sufficient to receive therewithin an upper end of the head of a tennis racquet. Three parallel and spaced walls or webs 34, 36 and 38 extend transversely across the lower end of the case between the side and rear walls and the open side 33 to form a pair of compartments 42 and 44 suitable for the storage of such items as tennis balls, shoes, socks etc. A pair of walls 46 and 48 perpendicular to the rear wall 28 extend upward in a relatively closely spaced parallel relationship from the wall 34, and then diverge at upper ends thereof to the side walls 30 and 32. Along with the top portion of the side walls, the walls 46 and 48 define therewithin a compartment or recess 50 in the shape of a tennis racquet. The compartment is of sufficient area to accommodate therewithin tennis racquets of the largest possible size, and the case is of sufficient depth to hold a plurality of the racquets, such as four racquets for players engaged in a doubles match. The outer sides of the walls 46 and 48 also form, along with the side walls 30 and 32, an additional pair of storage compartments 52 and 54 for various other items, such as a thermos of a drinkable beverage and shoes.

Figure 2:
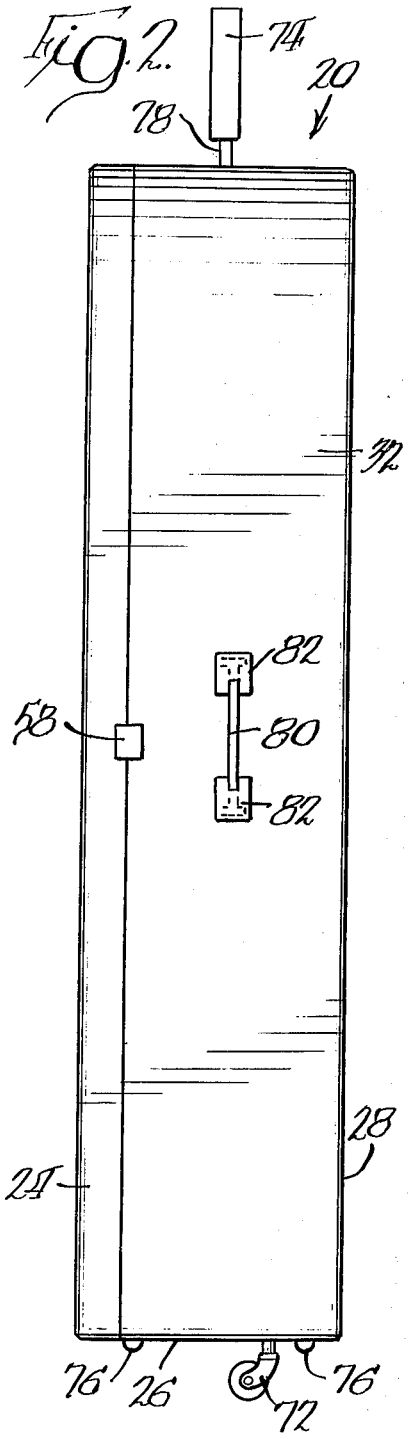
FIG. 2 is a side elevation view of the carrier with the door in a closed position.
Figure 3:
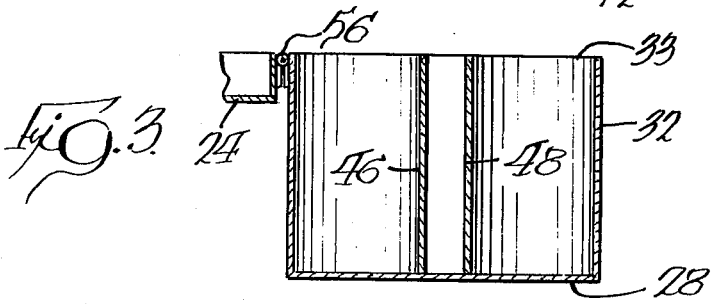
FIG. 3 is a cross-section view taken along the lines 3—3 of FIG. 1, and illustrates the inner walls extending from the front of the carrier to a rear wall thereof.

The door 24 conforms generally in shape with the open side 33 of the case, and is mounted on the side wall 30 by a plurality of hinges 56 for movement between an open position as shown in FIG. 1 whereat the interior of the case is readily accessible, to a closed position as shown in FIG. 2 whereat the door closes the open side to seal the interior of the case against rain or other adverse weather conditions and to prevent physical contact of the tennis equipment therewithin with objects exterior of the case. The door 24 is latchable in its closed position by a lock 58, which may be a key lock to provide security for the contents of the carrier. To conveniently hold individual toiletry or other personal items, an inner surface 60 of the door is provided with one or more pockets and/or elastic bands, such as the pockets 62 and the elastic band 64. The pockets may be of a decorative elastic material 66 provided with reinforcing ribs or struts along the edges thereof which are fastened to the door to form the pocket with an opening at the upper end thereof. The elastic band 64 may be of a strip of similar elastic material extended across the door and fastened to the door both at its ends and along a pair of spaced lines 68 to form three discrete strap sections 70 suitable for receiving and holding such items as hair brushes, combs, eyeglasses or the like.

The carrier 20 thus has a plurality of compartmentalized areas for conveniently receiving and maintaining separate equipment used in the playing of tennis. As a consequence, the equipment is readily accessible, and any interaction or bumping between the various pieces of equipment, which could otherwise damage the equipment, is prevented. Further, with the door closed the relatively rigid carrier protects the articles therewithin not only against impact with external objects, but also against adverse weather conditions such as rain, a particularly important feature where the racquets are strung with cat gut which may be ruined if exposed to excessive moisture. If desired, the interior surfaces of the case may be covered with a suitable decorative material such as velvet or felt to further enhance the esthetic appeal of the carrier.

For convenient transport of the carrier, means are provided whereby it may be either rolled or physically carried. For rolling transport, a pair of rollers or castors 72 extend downwardly of the base wall, and a grippable cylindrical handle 74 is provided at the upper end of the carrier for either pushing or puling the carrier on the rollers. The rollers are pivotally fastened to the bottom of the carrier, and when they are not in use they may be swung upward through openings (not shown) in the base wall for storage within an area formed between the base wall and the wall 38. When so stored, the carrier rests on four feet 76 which are integrally formed with the base wall in proximity with the corners thereof. Preferably, the handle 74 is telescopically engaged with a cylinder element 78 fastened to the upper end of the case, whereby the handle may be extended outwardly from the cylinder element for conveniently being held during transport of the carrier, and extended inwardly of the cylinder element to minimize the overall height of the carrier for storage or other handling thereof. For picking up and transporting the carrier, a handle 80 is secured to the side wall 32 by a pair of brackets 82. The handle is essentially flush with the surface of the wall when not in use, yet is movable within the brackets away from the surface for convenient gripping thereof.

The invention thus provides a carrier for tennis equipment which is capable of containing therewithin all of the equipment normally associated with the playing of tennis. As a consequence of the carrier being compartmentalized the equipment is readily accessible and damage to the equipment resulting from bumping interaction is prevented. With the door to the carrier closed, the equipment is completely encased and securely locked therewithin, and is protected from damage by bumping engagement with external objects as well as from exposure to adverse weather conditions. The carrier is esthetically attractive, easily transportable, and may be of any desirable size, such as a size sufficient to hold equipment for four players, an advantage and convenience where doubles tennis is being played.

While one particular embodiment of the invention has been described in detail, various embodiments and other modifications thereof may be devised by one skilled in the art without departing from the spirit and the scope of the invention, as defined by the claims.

What is claimed is:

1. In a carrier for tennis equipment, a case having a rear wall, a base wall and a pair of side walls, said side and base walls being joined with said rear wall and extending therefrom to form an opening to said case, said side walls extending from said base wall and curving toward each other to form a semicircular top portion of said case opposite from said base wall; inner walls in said case configured to form a racquet shaped recess of sufficient size to receive a racquet therewithin, said inner walls being first and second walls extending in spaced parallel relationship from lower ends thereof toward said top wall portion to form a section of said recess for receiving a handle of a racquet, said first and second walls curving outward from each other at upper ends thereof toward said side walls to form with said top portion a section of said recess for receiving a head of a racquet; a third wall contiguous with the lower ends of said first and second walls and extending between said side walls and spaced from the base wall to form with said first, second, and side walls first and second storage compartments; and a door pivotally connected with said case for movement between a position away from said opening to said case and a position closing said opening to said case.

2. In a carrier for tennis equipment as set forth in claim 1, said door being pivotally connected with one of said side walls, and including a latch for securing said door with said other side wall when said door is closing said opening.

3. In a carrier for tennis equipment as set forth in claim 1, fourth and fifth walls extending between and perpendicular to said side walls in spaced relationship between said third and said base walls, said third and fourth walls forming a third equipment storage compartment therebetween, said fourth and fifth walls forming a fourth equipment storage compartment therebetween, said fifth wall being spaced from said base wall; a pair of rollers secured to said base between said fifth and base walls and extendable outward of said wall to rollingly support said carrier, and movable inward of said base wall and between said base and fifth walls to rest said carrier on said base wall, and a handle secured to said top wall portion for being gripped when said rollers are extended from said base for moving said carrier on said rollers.

4. In a carrier for tennis equipment as set forth in claim 3, said handle secured to said top wall portion being telescopic between an extended position away from said top portion for being gripped to move said carrier, and a retracted position toward said top portion, and including another handle secured to one of said side walls and being grippable for elevating and transportion said carrier.

5. In a carrier for tennis equipment as set forth in claim 4, said door having at least one pocket on an inner surface thereof for holding equipment therewithin and an elastic band extended thereacross for elastically holding said equipment against said inner surface, said first, second, third, fourth and fifth walls extending perpendicular to said rear wall from a position contiguous therewith to adjacent said opening to said case.

* * * * *